US010801337B2

(12) United States Patent
Seo et al.

(10) Patent No.: US 10,801,337 B2
(45) Date of Patent: Oct. 13, 2020

(54) STEAM TURBINE

(71) Applicant: DOOSAN HEAVY INDUSTRIES & CONSTRUCTION CO., LTD., Changwon-si, Gyeongsangnam-do (KR)

(72) Inventors: Min Soo Seo, Changwon-si (KR); Jung Ho Lee, Busan (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 0 days.

(21) Appl. No.: 16/178,576

(22) Filed: Nov. 1, 2018

(65) Prior Publication Data

US 2019/0153881 A1 May 23, 2019

(30) Foreign Application Priority Data

Nov. 23, 2017 (KR) ..... 10-2017-0157494

(51) Int. Cl.
*F01D 5/30* (2006.01)
*F01D 5/14* (2006.01)

(52) U.S. Cl.
CPC ..... *F01D 5/3007* (2013.01); *F01D 5/141* (2013.01); *F05D 2240/121* (2013.01); *F05D 2240/122* (2013.01); *F05D 2240/80* (2013.01); *F05D 2250/38* (2013.01)

(58) Field of Classification Search
CPC ..... F01D 5/141; F01D 5/143; F01D 5/145; F01D 5/3007; F05D 2240/121
See application file for complete search history.

(56) References Cited

U.S. PATENT DOCUMENTS 4,426,867 A * 1/1984 Neal ..... C21D 7/06 29/889.7
4,650,399 A * 3/1987 Craig ..... F01D 5/187 416/97 R
4,767,274 A * 8/1988 Walter ..... F01D 5/147 416/193 A (Continued)

FOREIGN PATENT DOCUMENTS

KR 10-2016-0098182 A 8/2016

OTHER PUBLICATIONS

A Korean Office Action dated Feb. 1, 2019 in connection with Korean Patent Application No. 10-2017-0157494 which corresponds to the above-referenced U.S. application.

*Primary Examiner* — Nathaniel E Wiehe
*Assistant Examiner* — Ryan C Clark
(74) *Attorney, Agent, or Firm* — Invenstone Patent, LLC

(57) ABSTRACT

A steam turbine includes a platform (100) including a front part on an upstream side of the platform, a rear part opposite the front part, and a side part extending between the front part and the rear part; a vane (200) provided on an upper surface of the platform, the vane including a leading edge facing the front part and a trailing edge extending from the front part via the side part to the rear part; and a dovetail (300) formed integrally with the platform. The dovetail slant angle (DSA) is created when the horizon is drawn at an angle formed by a dovetail center axis (DCA) of the dovetail and a rotation axis (RA), and the stagger angle (SA) corresponds to an angle formed by the leading edge and the trailing edge of the vane. The dovetail slant angle is less than the stagger angle.

18 Claims, 4 Drawing Sheets

(56) References Cited

U.S. PATENT DOCUMENTS

| | | | | |
|---|---|---|---|---|
| 5,067,876 | A * | 11/1991 | Moreman, III | F01D 5/3007 416/219 R |
| 5,286,168 | A * | 2/1994 | Smith | F01D 5/16 416/193 A |
| 6,558,121 | B2 * | 5/2003 | Zhu | F01D 5/143 29/889.7 |
| 8,657,579 | B2 * | 2/2014 | Reno | F01D 5/22 415/209.4 |
| 2006/0127214 | A1 * | 6/2006 | Glasspoole | F01D 5/143 415/191 |
| 2010/0143139 | A1 * | 6/2010 | Pandey | F01D 5/143 416/179 |
| 2014/0377077 | A1 * | 12/2014 | Gruber | F01D 5/141 416/228 |
| 2016/0177766 | A1 | 6/2016 | Rioux | |

* cited by examiner

[FIG. 1]
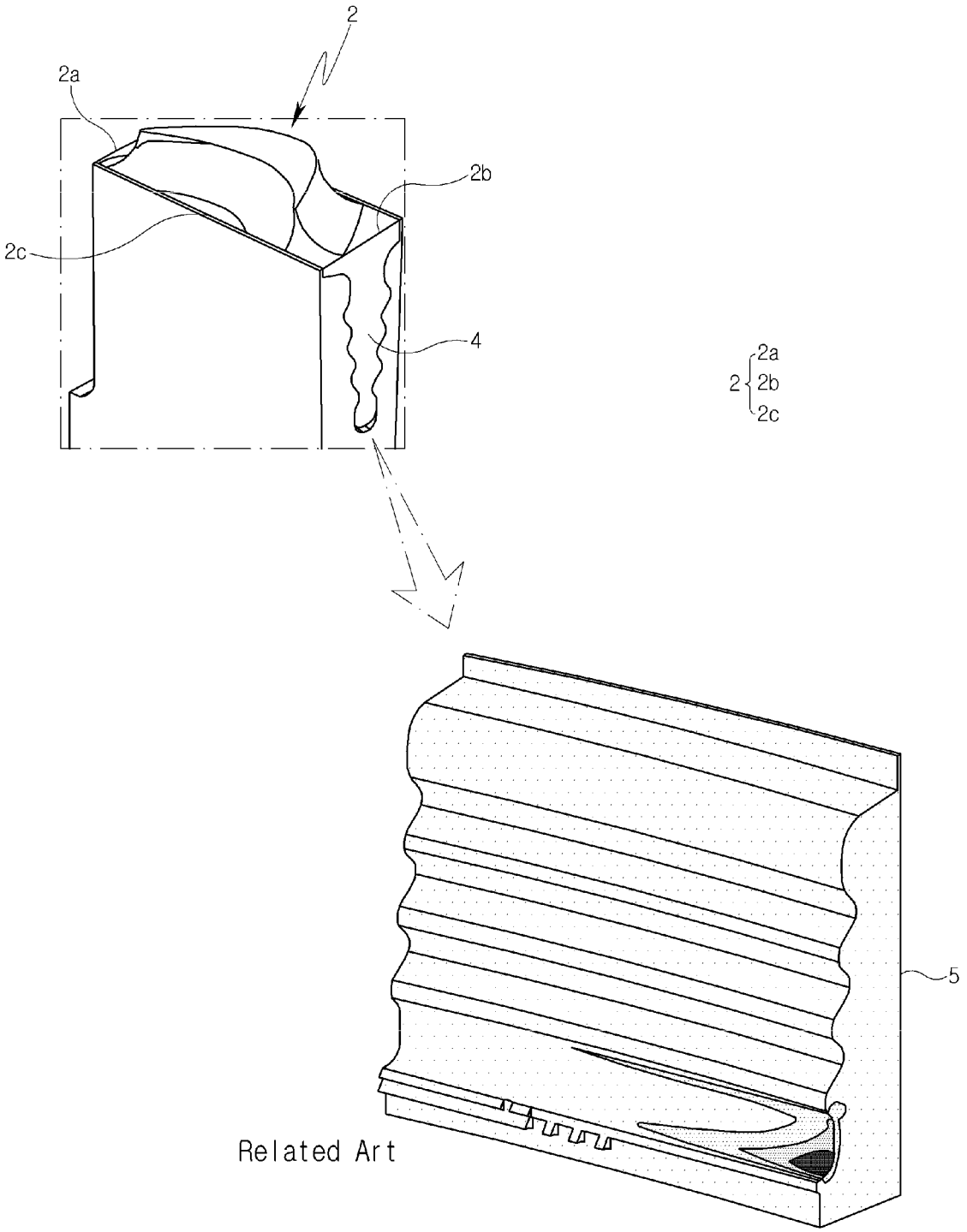

[FIG. 2]
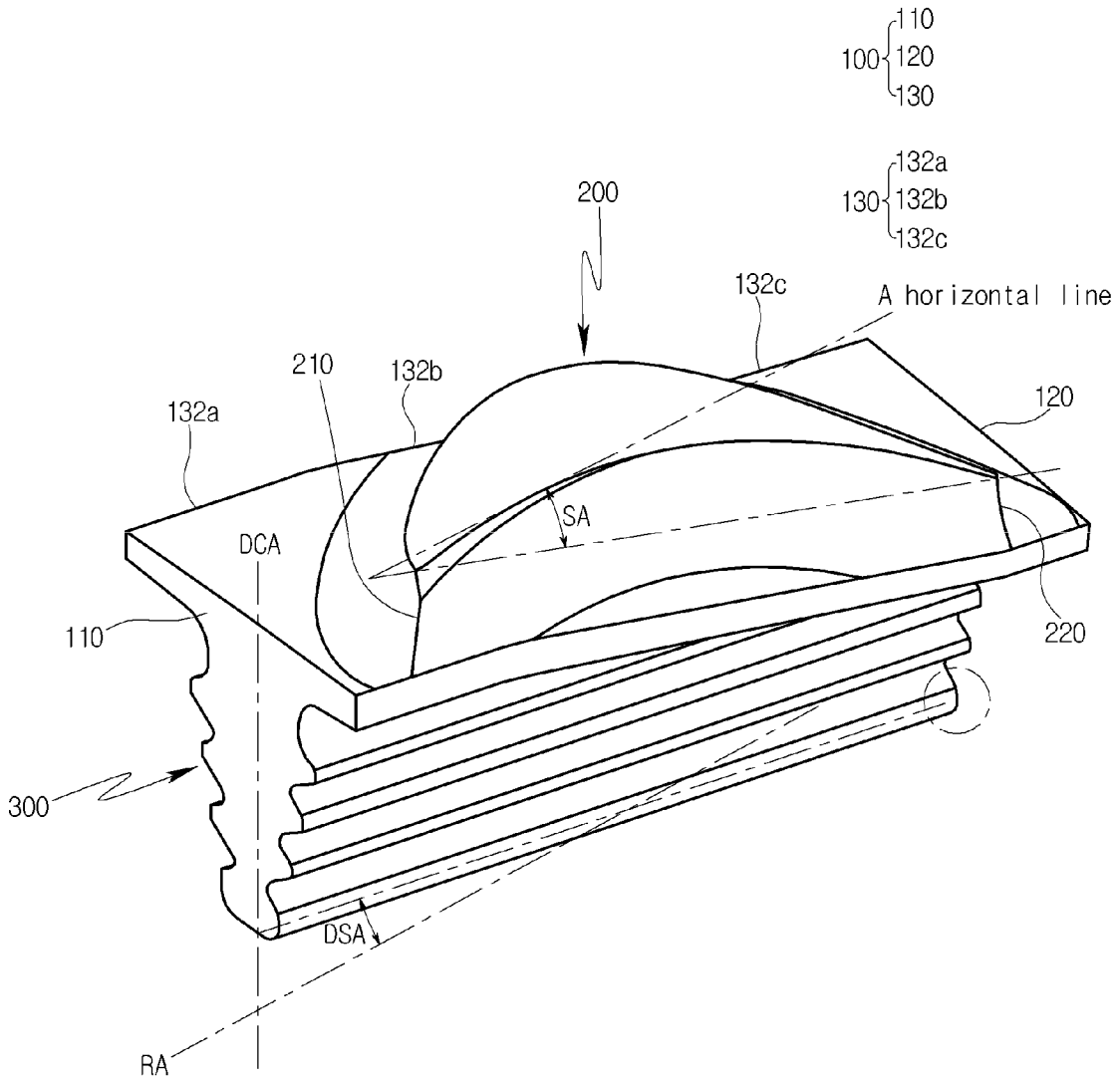

[FIG. 3]
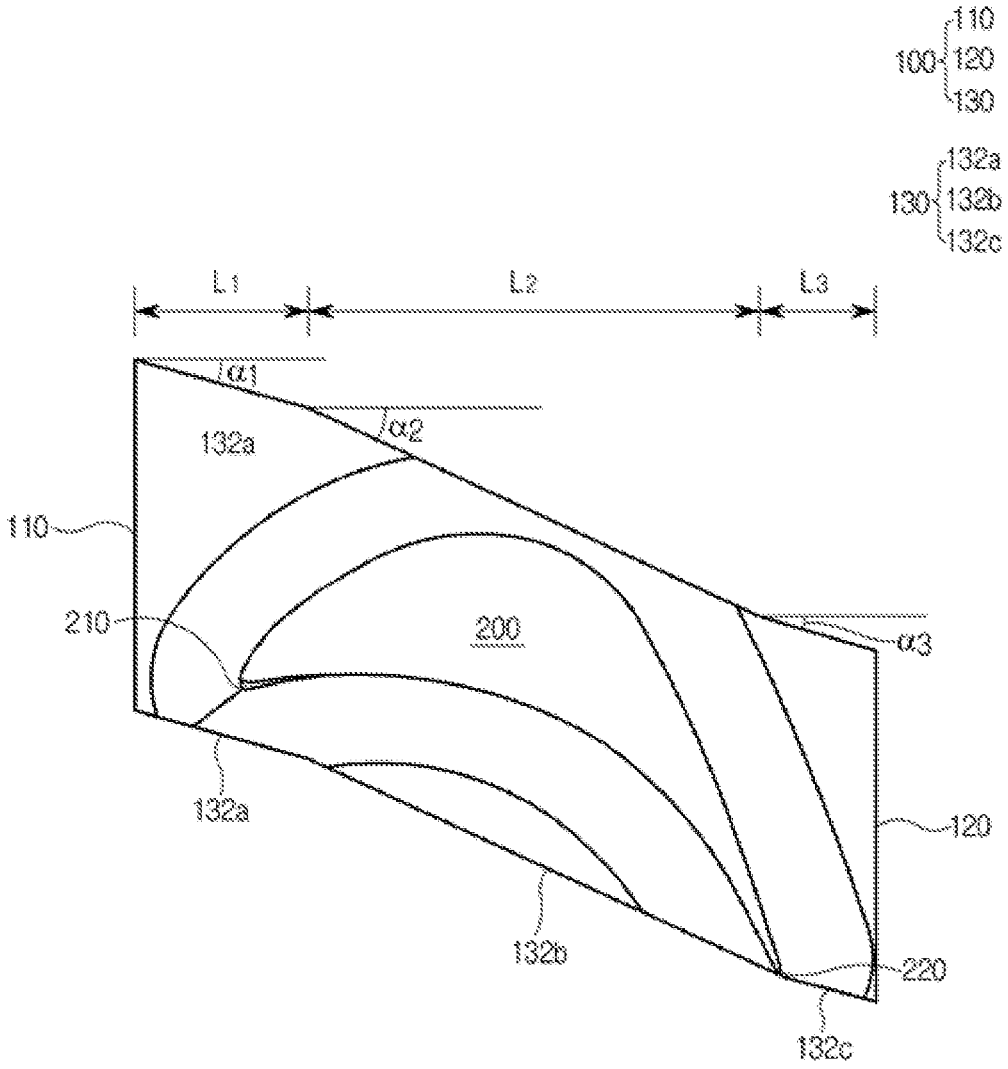

[FIG. 4]
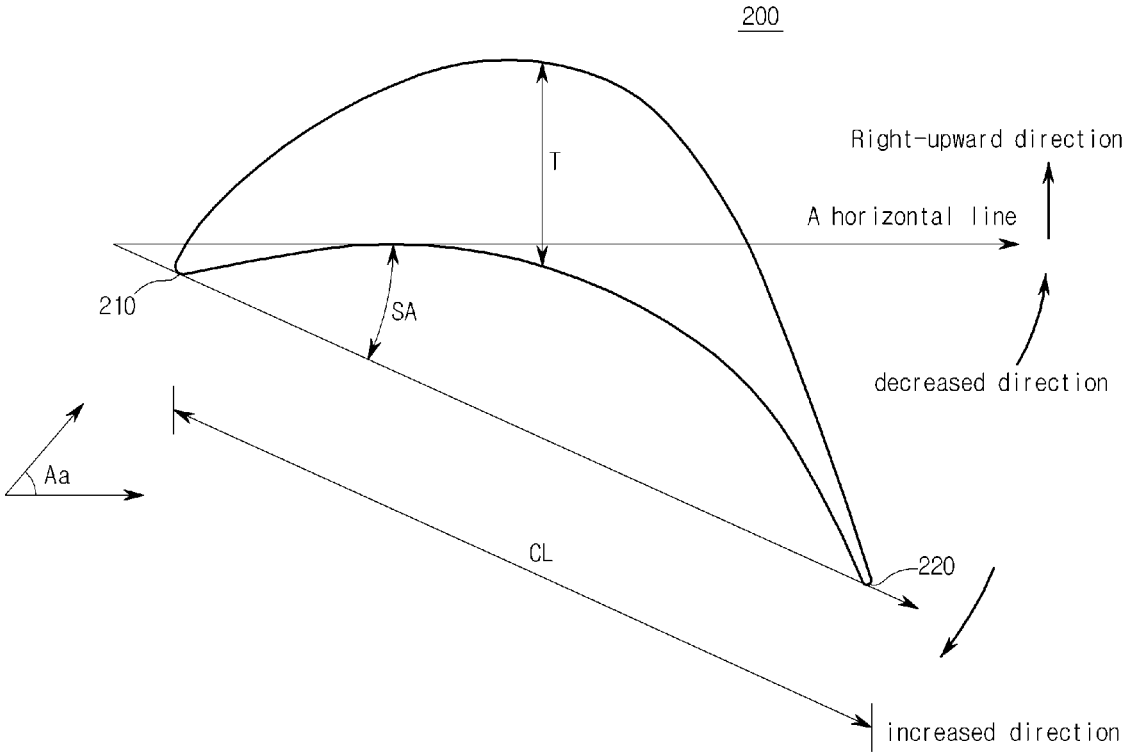

STEAM TURBINE

CROSS-REFERENCE TO RELATED APPLICATIONS

This application claims priority to Korean Patent Application No. 10-2017-0157494, filed on Nov. 23, 2017, the disclosure of which is incorporated herein by reference in its entirety.

BACKGROUND OF THE INVENTION

Field of the Invention

Exemplary embodiments of the present disclosure relate to steam turbines, and more particularly, to a platform included in a vane of a steam turbine in which stress concentration issues are overcome by changing the shape of a side part of the platform.

Description of the Related Art

A turbine is a machine that converts the energy of a flowing fluid such as water, gas, or steam into mechanical work and is typically referred to as a turbomachine. The fluid forcefully flows over many buckets or blades, which are mounted to the circumference of a rotating body of the turbine, and thus rotates the rotating body at high speed. Examples of a turbine include a water turbine using the energy of elevated water, a gas turbine using the energy of high-temperature and high-pressure gas, an air turbine using the energy of high-pressure compressed air, and a steam turbine using the energy of steam. Among these, the steam turbine is configured to rotate a rotating unit by jetting steam from a nozzle to blades, to thereby convert the energy of the steam into mechanical work. The steam turbine includes a casing that forms its frame and establishes an external appearance, a rotating unit that is rotatably installed in the casing, and a nozzle that jets steam toward the rotating unit.

A steam turbine as described above includes a vane provided on an upper surface of a platform, and FIG. 1 shows a contemporary configuration of a platform 2 and a vane (not shown) in order to illustrate a stress concentration in the vane.

Referring to FIG. 1, the platform 2 includes a front part 2*a*, a rear part 2*b*, and a side part 2*c*. The vane (not shown) is provided on the upper surface of the platform 2.

Typically, a platform may have a C-shape or a rectilinear shape. The conventional platform 2 of FIG. 1 has a rectilinear shape in which the side part 2*c* extends in a straight line. The rectilinearly shaped platform 2 is problematic in that a stress concentration is increased at the lower end of the platform 2 when a dovetail 4 is inserted into a rotor disk 5.

In particular, to prevent malfunctions when the steam turbine is operated for a long time, the platform 2 must be configured such that the vane 3 is stably fixed and stress is not excessively concentrated at a specific position when the vane 3 rotates.

SUMMARY OF THE INVENTION

An object of the present disclosure is to provide a steam turbine capable of minimizing an occurrence of stress concentration on a dovetail by making a dovetail slant angle (DSA) smaller than a stagger angle (SA) of a vane included in the steam turbine.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an aspect of the present disclosure, a steam turbine may include a platform (100) comprising a front part (110) oriented toward an upstream side of the platform, a rear part (120) oriented toward a downstream side of the platform, and a side part (130) extending between the front part and the rear part; a vane (200) provided on an upper surface of the platform, the vane including a leading edge (210) facing the front part and a trailing edge (220) extending from the front part via the side part to the rear part; and a dovetail (300) formed integrally with the platform and extending away from the vane. A dovetail slant angle (DSA) may be created when the horizon is drawn at an angle formed by a dovetail center axis (DCA) of the dovetail and a rotation axis (RA). A stagger angle (SA) may correspond to an angle formed by the leading edge and the trailing edge of the vane. The dovetail slant angle may be less than the stagger angle.

The stagger angle of the vane may be an angle between 22° and 26°.

The stagger angle of the vane may be an angle of 24°.

The dovetail slant angle may be an angle between 13° and 17°.

The dovetail slant angle may be an angle of 15°.

The vane may have an angle of attack (Aa) between 22° and 26°.

The vane may have a chord length (CL) of 140 mm.

The vane may have a maximum thickness (T) of 36 mm.

The leading edge of the vane may have a radius of 0.7 mm.

The side part may include a first inclined portion (132*a*) extending from the front part toward the rear part by a first length (L1); a second inclined portion (132*b*) extending from the rear part toward the front part by a second length (L2); and a third inclined portion (132*c*) having a third length (L3) to connect the first and second inclined portions. The third length may be shorter than the first length. The first and second inclined portions may be formed at the same angle of inclination, and the third inclined portion may be formed at a different angle of inclination from either of the first and second inclined portions. The third inclined portion may be formed at a greater angle of inclination than either of the first and second inclined portions. The first and second inclined portions may be inclined at an angle of 15°, and the third inclined portion may be inclined at an angle of 24°. The first inclined portion may extend from the front part to a position passing through the leading edge by a predetermined length; and the second inclined portion may extend from the rear part to a position passing through the trailing edge by a predetermined length. Each of the first and second inclined portions may be shorter than the third inclined portion.

In accordance with another aspect of the present disclosure, there is provided a steam turbine comprising a platform (100) and a vane (200). The platform may be included in a unit compressor at an initial stage from among a plurality of unit compressors constituting a compressor unit.

The steam turbine may further include a plurality of compressors constituting a compressor unit, and the platform may be included in an initial-stage compressor of the plurality of compressors.

The leading edge may be positioned in the middle of the total length of the first inclined portion and extends toward the trailing edge. The vane may be configured such that the trailing edge extends to be further inclined downward than the leading edge when viewed from the side part.

In accordance with another aspect of the present disclosure, a steam turbine may include the above platform, the vane, and the dovetail as described above, wherein the platform and the vane are included in a compressor of a turbine.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a perspective view of a platform and a vane included in a steam turbine according to a related art;

FIG. 2 is a perspective view illustrating a vane, a platform, and a dovetail according to an embodiment of the present disclosure;

FIG. 3 is a top view of FIG. 2; and

FIG. 4 is a diagram of the vane according to the embodiment of the present disclosure.

DESCRIPTION OF SPECIFIC EMBODIMENTS

Reference will now be made in detail to exemplary embodiments of the present disclosure, examples of which are illustrated in the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Hereinafter, a steam turbine according to exemplary embodiments of the present disclosure will be described with reference to the accompanying drawings. According to the present disclosure, the occurrence of stress concentration on a distal end of a dovetail can be minimized by making a dovetail slant angle (DSA) smaller than a stagger angle (SA).

Referring to FIGS. 2 to 4, the dovetail slant angle DSA of a dovetail 300 corresponds to an angle formed by a dovetail center axis DCA of the dovetail 300 and a rotation axis RA, and the stagger angle SA corresponds to an angle formed by a leading edge 210 and a trailing edge 220 of a vane 200. According to the present disclosure, the dovetail slant angle DSA is less than the stagger angle SA.

To this end, a steam turbine according to a first embodiment includes a platform 100 that has a front part 110 oriented toward the upstream side of the platform 100 and facing the inflowing steam, a rear part 120 formed opposite the front part 110 and oriented toward the downstream side of the platform 100 to face in the direction of outflowing steam, and a side part 130 extending between the front part 110 and the rear part 120.

The steam turbine further includes a vane 200 that is provided on the upper surface of the platform 100 and includes a leading edge 210 and a trailing edge 220. The leading edge 210 faces toward the front part 110, and the trailing edge 220 extends from the front part 110 via the side part 130 to the rear part 120. The vane 200 extends upward from the upper surface of the platform 100 and has an airfoil shape as a whole. With respect to the drawings, the leading edge 210 is formed at the left front end of the vane 200 and the trailing edge 220 is formed at the right rear end.

The steam turbine further includes a dovetail 300 that is formed integrally with the platform 100 and extends away from the vane 200. That is, the dovetail 300 includes a distal end that extends inwardly toward the center of the rotor disk.

Especially, as described above, the steam turbine is configured such that the dovetail slant angle DSA of the dovetail 300 is smaller than the stagger angle SA of the vane 200.

In an exemplary embodiment of the present disclosure, the stagger angle SA refers to an angle formed by a line leading from the leading edge 210 to the trailing edge 220 and a line extending horizontally from the leading edge 210. The stagger angle SA may be between 22° and 26°. The stagger angle SA may be increased or decreased depending on the extended position of the trailing edge 220, and is correlated with the total area of the platform 100.

For example, in the case where the position of the trailing edge 220 extends in a right-upward direction in the drawing, the stagger angle SA is decreased whereas the area of the side part 130 of the platform 100 is increased. On the contrary, in the case where the position of the trailing edge 220 extends downward in the drawing, the stagger angle SA is increased and the area of the rear part 120 of the platform 100 is increased.

Thus, the present embodiment can minimize an occurrence of stress concentration on the dovetail 300 when the steam turbine is manufactured such that the stagger angle SA is selected from the above range of angles, to minimize the stress concentration on the distal end of the dovetail 300 while the increase in area of the platform 100 is minimized.

The optimal stagger angle SA of the vane 200 set at 24°, i.e., the midpoint of the 22° to 26° range, is the most stable angle to minimize the stress concentration of the dovetail 300. That is, the stagger angle SA of 24° corresponds to the most advantageous angle to minimize flow separation of hot gas flowing along the surface of the vane 200. Accordingly, a variation in pressure due to the flow separation in the vane 200 is minimized.

The detailed configuration of the vane 200 will be described in more detail. For example, the vane 200 has an angle of attack Aa between 22° and 26°. The angle of attack Aa corresponds to an angle formed by the leading edge 210 with respect to a flow of steam striking the vane 200.

The leading edge 210 may stably guide a flow of hot gas when the optimal angle of attach Aa is, for example, an angle of 24° selected from the above range of angles of attack Aa.

The vane 200 has a chord length CL of 140 mm, and the length corresponds to a length selected from the above range of angles of the stagger angle SA. The vane 200 has a maximum thickness T of 36 mm, and the leading edge 210 has a radius of 0.7 mm. The maximum thickness T of 36 mm illustrated in the drawing refers to the most advantageous dimension to minimize an occurrence of flow separation since the flow of steam along the surface of the vane 200 changes a trajectory of hot gas flowing to the trailing edge 220. The maximum thickness T of 36 mm is preferably maintained, because increasing the maximum thickness T may cause instability in the flow of hot gas at the trailing edge.

The dovetail slant angle DSA of the present embodiment is selected between 13° and 17°.

When steam flows along the vane 200 after the dovetail 300 is inserted into the rotor disk, a stress is concentrated at a position indicated by the circular dotted line, on the dovetail 300. Stress concentration at this position is proportionally increased as the dovetail slant angle DSA is increased. Minimum stress concentration can be achieved when the dovetail slant angle DSA is 0°, but it is difficult for the dovetail slant angle DSA to be 0°. Thus, the steam turbine of the present embodiment is configured such that the dovetail slant angle DSA is selected from the above range of angles.

The dovetail slant angle DSA corresponds to an angle formed when the horizon is drawn (from the front to the rear of the dovetail) at the intersection between the rotation axis RA and the dovetail center axis DCA of the dovetail 300. Here, the dovetail center axis DCA is a line extending from the twelve o'clock position to the six o'clock position.

The dovetail slant angle DSA is, for example, an angle of 15°, and is smaller than the stagger angle SA. In this case, the stress concentration is minimized on the distal end of the dovetail 300, and the shape change of the vane 200 or platform 100 may be minimized, which minimizes an increase in unnecessary area.

In addition, each of the vane 200 and the platform 100 may stably maintain a balance in its left and right weights, which can minimize a problem relating to stress concentration on the extended end of the dovetail 300.

The side part 130 of the present embodiment includes a first inclined portion 132*a* that extends from the front part 110 to the rear part 120 by a first length L1, a second inclined portion 132*b* that extends from the rear part 120 to the front part 110 by a second length L2, and a third inclined portion 132*c* that has a third length L3 to connect the first inclined portion 132*a* and the second inclined portion 132*b*.

In the present embodiment, when viewing the platform 100 from the top, in the FIG. 3, the left refers to the front part 110, the right refers to the rear part 120, and the side part 130 is formed between the front part 110 and the rear part 120.

In particular, the side part 130 includes the first to third inclined portions 132*a*, 132*b*, and 132*c* without connecting the front part 110 and the rear part 120 in a rectilinear manner.

The first inclined portion 132*a* extends from the front part 110 to a position passing through the leading edge 210 by a predetermined length, and the second inclined portion 132*b* extends from the rear part 120 to a position passing through the trailing edge 220 by a predetermined length.

The first and second inclined portions 132*a* and 132*b* are each shorter than the third inclined portion 132*c*. This is to maintain the left-right balance of the dovetail 300 and to balance the weight.

The front part 110 and the rear part 120 may have the same length or different lengths. Thus, although the drawings suggest that the front part 110 and the rear part 120 have equal lengths, the present disclosure is intended to include front and rear parts having disparate lengths. These lengths may differ depending on the stress applied to the rear part 120.

The rear part 120 of the platform 100 may include a bend, which may lead to stress concentration between the platform 100 and the dovetail 300. However, the present embodiment forms the side part 130 for prevention so as to less affect the structural strength between the platform 100 and the dovetail 300 even when the stress is concentrated on the dovetail 300.

The first and second inclined portions 132*a* and 132*b* are formed at the same angle of inclination, and the third inclined portion 132*c* is formed at a different angle of inclination from the first and second inclined portions 132*a* and 132*b*.

The third inclined portion 132*c* is formed at a greater angle of inclination than either of the first and second inclined portions 132*a* and 132*b*. For example, the first and second inclined portions 132*a* and 132*b* are inclined at an angle of 15°, and the third inclined portion 132*c* is inclined at an angle of 24°.

The first and second inclined portions 132*a* and 132*b* are inclined at the same angle as the dovetail slant angle DSA, and the third inclined portion 132*c* is inclined at the same angle as the stagger angle SA.

Through such a configuration, the damage or deformation of the dovetail 300 due to the stress concentration on its distal end is minimized, and an upper end through which the platform 100 is connected to the dovetail 300 is uniformly maintained in its center of gravity while the T-shape thereof is not weighted toward a specific position.

When the center of gravity of the dovetail 300 is stably maintained, the dovetail 300 can be stably used even then it is used for a long time since the torsion or deformation of the dovetail 300 due to the pressure applied while steam flows may be minimized.

In the present embodiment, the third length L3 is shorter than the first length L1. The third length L3 is set as the length illustrated in the drawing in order for the extended portion of the third inclined portion 132*c* to stably maintain the overall weight balance of the dovetail 300.

In this case, the total area of the platform 100 is not particularly increased and the left-right balance of the platform 100 is stably maintained with respect to the dovetail center axis DCA. Therefore, the platform 100 can be stably used without an occurrence of excessive stress concentration at a specific position.

According to a second embodiment of the present disclosure, there is provided a steam turbine including a platform 100 and a vane 200. These platform 100 and vane 200 have the same configuration as those of the above-mentioned first embodiment.

In the present embodiment, the leading edge 210 is positioned in an intermediate position of the total length of the first inclined portion 132*a* and extends toward the trailing edge 220. When the leading edge 210 extends from the position (an intermediate position of the total length of the first inclined portion 132*a*), it is possible to accomplish a stable flow of fluid by minimizing turbulence occurring while steam flows from the leading edge 210 to the trailing edge 220, together with the action and effect by the above stress concentration.

The vane 200 is configured such that the trailing edge 220 extends to be further inclined downward than the leading edge 210 when viewed from the side part 130. In this case, it is possible to accomplish a stable flow of steam and reduce stress concentration as described above. Therefore, when the steam turbine is operated for a long time, it is possible to reduce stress concentration and minimize an occurrence of malfunction due to fatigue failure.

In addition, since the durability of the vane 200 is improved, it is possible to resolve a problem relating to interruption of power generation due to the malfunction or repair of the steam turbine.

A steam turbine according to a further embodiment of the present disclosure includes a platform 100 that has a front part 110 directed in an inflow direction of steam, a rear part 120 formed at the rear thereof from which the steam flows, and a side part 130 extending between the front part 110 and the rear part 120, a vane 200 that is provided on the upper surface of the platform 100 and has a leading edge 210 facing the front part 110 and a trailing edge 220 extending from the front part 110 via the side part 130 to the rear part 120, and a dovetail 300 that is formed integrally with the platform 100 and extends outward.

A dovetail slant angle DSA, which is created when the horizon is drawn at an angle formed by a dovetail center axis DCA of the dovetail 300 and a rotation axis RA, is smaller than a stagger angle SA which corresponds to an angle formed by the leading edge 210 and the trailing edge 220 of the vane 200.

The side part 130 includes a first inclined portion 132*a* that extends from the front part 110 to the rear part 120 by a first length L1, a second inclined portion 132*b* that extends from the rear part 120 to the front part 110 by a second length L2, and a third inclined portion 132*c* that has a third length L3 to connect the first inclined portion 132*a* and the second inclined portion 132*b*. The first and second inclined portions 132*a* and 132*b* are formed at the same angle of inclination, and the third inclined portion 132*c* is formed at a different angle of inclination from the first and second inclined portions 132*a* and 132*b*.

When the vane 200 has the above configuration, it is possible to minimize a change in shape of the platform 100 due to stress concentration. In addition, each of the vane 200 and the platform 100 may stably maintain a balance in its left and right weights, which can minimize a problem relating to stress concentration on the extended end of the dovetail 300.

Furthermore, the first to third inclined portions 132*a*, 132*b*, and 132*c* allow the damage or deformation of the dovetail 300 due to the stress concentration on its distal end to be minimized, and allow an upper end through which the platform 100 is connected to the dovetail 300 to be uniformly maintained in its center of gravity while the T-shape thereof is not weighted toward a specific position.

As is apparent from the above description, in accordance with the exemplary embodiments of the present disclosure, it is possible to minimize a phenomenon in which a stress is concentrated on the end of the dovetail by changing the structure of the vane included in the steam turbine, and to reduce a maximum stress due to the stress concentration and secure structural safety.

In accordance with the exemplary embodiments of the present disclosure, it is possible to accomplish a stable flow of steam passing over the vane and minimize an occurrence of flow separation, and to minimize a variation in pressure occurring on the surface of the vane.

In accordance with the exemplary embodiments of the present disclosure, it is possible to simultaneously improve the stability of the platform and the stability of the dovetail by optimizing the length and angle of the side part of the platform.

While the present disclosure has been described with respect to the specific embodiments, it will be apparent to those skilled in the art that various changes and modifications may be made without departing from the spirit and scope of the disclosure as defined in the following claims.

What is claimed is:

1. A steam turbine comprising:

a platform comprising a front part oriented toward an upstream side of the platform, a rear part oriented toward a downstream side of the platform, and a side part extending between the front part and the rear part, the side part including:

a first inclined portion extending from the front part toward the rear part by a first length, a second inclined portion extending from the rear part toward the front part by a second length, and a third inclined portion having a third length to connect the first and second inclined portions, the third inclined portion formed at a greater angle of inclination than either of the first and second inclined portions;

a vane provided on an upper surface of the platform, the vane including a leading edge facing the front part and a trailing edge extending from the front part via the side part to the rear part; and a dovetail formed integrally with the platform and extending away from the vane, wherein a dovetail slant angle (DSA) is created when a horizon is drawn at an angle formed by a dovetail center axis (DCA) of the dovetail and a rotation axis (RA), wherein a stagger angle (SA) corresponds to an angle formed by the leading edge and the trailing edge of the vane, and wherein the dovetail slant angle is less than the stagger angle.

2. The steam turbine according to claim 1, wherein the stagger angle of the vane is an angle between 22° and 26°.

3. The steam turbine according to claim 1, wherein the stagger angle of the vane is an angle of 24°.

4. The steam turbine according to claim 1, wherein the dovetail slant angle is an angle between 13° and 17°.

5. The steam turbine according to claim 1, wherein the dovetail slant angle is an angle of 15°.

6. The steam turbine according to claim 1, wherein the vane has an angle of attack (Aa) between 22° and 26°.

7. The steam turbine according to claim 1, wherein the vane has a chord length (CL) of 140 mm.

8. The steam turbine according to claim 1, wherein the vane has a maximum thickness (T) of 36 mm.

9. The steam turbine according to claim 1, wherein the leading edge of the vane has a radius of 0.7 mm.

10. The steam turbine according to claim 1, wherein the third length is shorter than the first length.

11. The steam turbine according to claim 1, wherein the first and second inclined portions are formed at the same angle of inclination, and the third inclined portion is formed at a different angle of inclination from either of the first and second inclined portions.

12. The steam turbine according to claim 1, wherein the first and second inclined portions are inclined at an angle of 15°, and the third inclined portion is inclined at an angle of 24°.

13. The steam turbine according to claim 1, wherein:

the first inclined portion extends from the front part to a position passing through the leading edge by a predetermined length; and the second inclined portion extends from the rear part to a position passing through the trailing edge by a predetermined length.

14. The steam turbine according to claim 1, wherein each of the first and second inclined portions is shorter than the third inclined portion.

15. The steam turbine according to claim 1, further comprising a plurality of compressors constituting a compressor unit, wherein the platform is included in an initial-stage compressor of the plurality of compressors.

16. The steam turbine according to claim 1, wherein the leading edge is positioned in the middle of the total length of the first inclined portion and extends toward the trailing edge.

17. The steam turbine according to claim 1, wherein the vane is configured such that the trailing edge extends to be further inclined downward than the leading edge when viewed from the side part.

18. A steam turbine comprising:

a platform comprising a front part oriented toward an upstream side of the platform, a rear part oriented toward a downstream side of the platform, and a side part extending between the front part and the rear part, the side part comprising:

a first inclined portion extending from the front part toward the rear part by a first length, a second inclined portion extending from the rear part toward the front part by a second length, and a third inclined portion having a third length to connect the first and second inclined portions;

a vane provided on an upper surface of the platform, the vane including a leading edge facing the front part and a trailing edge extending from the front part via the side part to the rear part; and a dovetail formed integrally with the platform and extending away from the vane, wherein each of the first and second inclined portions is formed at the same angle of inclination, and the third inclined portion is formed at a greater angle of inclination than either of the first and second inclined portions, and wherein a dovetail slant angle (DSA) is created when a horizon is drawn at an angle formed by a dovetail center axis (DCA) of the dovetail and a rotation axis (RA), a stagger angle (SA) corresponds to an angle formed by the leading edge and the trailing edge of the vane, and the dovetail slant angle is less than the stagger angle.

* * * * *